US008246780B2

(12) United States Patent
Duggirala et al.

(10) Patent No.: US 8,246,780 B2
(45) Date of Patent: Aug. 21, 2012

(54) METHODS FOR ENHANCING BRIGHTNESS AND RESISTANCE TO THERMAL YELLOWING OF BLEACHED KRAFT PULP AND PAPER

(75) Inventors: Prasad Duggirala, Naperville, IL (US); Sergey Shevchenko, Aurora, IL (US)

(73) Assignee: Nalco Company, Naperville, IL (US)

( * ) Notice: Subject to any disclaimer, the term of this patent is extended or adjusted under 35 U.S.C. 154(b) by 112 days.

(21) Appl. No.: 11/387,499

(22) Filed: Mar. 23, 2006

(65) Prior Publication Data

US 2007/0062653 A1 Mar. 22, 2007

Related U.S. Application Data

(60) Provisional application No. 60/721,847, filed on Sep. 29, 2005, provisional application No. 60/718,475, filed on Sep. 19, 2005.

(51) Int. Cl.
*D21H 17/63* (2006.01)
*D21H 11/16* (2006.01)

(52) U.S. Cl. ..... 162/82; 162/70; 162/160

(58) Field of Classification Search ..... 162/70, 162/82, 160

See application file for complete search history.

(56) References Cited

U.S. PATENT DOCUMENTS

| | | | | |
|---|---|---|---|---|
| 3,619,355 | A * | 11/1971 | Silberman | 162/135 |
| 3,904,685 | A * | 9/1975 | Shahidi et al. | 562/594 |
| 4,238,282 | A * | 12/1980 | Hyde | 162/76 |
| 5,035,772 | A * | 7/1991 | Agnemo et al. | 162/72 |
| 5,368,689 | A * | 11/1994 | Agnemo | 162/135 |
| 6,527,914 | B1 | 3/2003 | Shevchenko et al. | |
| 6,998,015 | B2 | 2/2006 | Hua et al. | |
| 2002/0059999 | A1 | 5/2002 | Hua et al. | |
| 2002/0088574 | A1* | 7/2002 | Seltzer et al. | 162/72 |
| 2003/0085008 | A1 | 5/2003 | Duggirala et al. | |
| 2003/0188393 | A1* | 10/2003 | Tindal | 8/532 |
| 2004/0154764 | A1 | 8/2004 | Blum et al. | |
| 2004/0173328 | A1* | 9/2004 | Hu et al. | 162/70 |

FOREIGN PATENT DOCUMENTS

| | | | |
|---|---|---|---|
| EP | 0905317 | A1 * | 3/1999 |
| JP | 09-49195 | A | 2/1997 |
| WO | WO 2005/001198 | | 6/2005 |

OTHER PUBLICATIONS

Roick Thomas, Optical Brighteners in Fine Papers, 1999, TAPPI Press,whole document.*

Smook, Handbook for Pulp and Paper Technologists, 1992, Angus Wilde Publications, 2nd edition, p. 228, 283, 207.*

Smook, Handbook for Pulp and Paper Technologists, 1992, Angus Wilde Publications, 2nd edition, p. 38-39.*

Tran A.V., Thermal Yellowing of Hardwood Kraft Pulp Bleached with a chlorine Dioxide Based Sequence, Apr. 2002, JPPS, vol. 28, whole document.*

Machine English Translation of JP-09-049195 Tokushu, 1997.*

Smook, Handbook for Pulp and Paper Technologists, 1992, Angus Wilde Publications, 2nd edition, p. 208 and 264.*

Ghosh, A.; Ni, Y.; "Metal Ion Complexes and Their Relationship to Pulp Brightness"; Journal of Pulp and Paper Science; vol. 24,; No. 1; pp. 26-31; 1998.

Ni, Y.; Ghosh, A.; Li, Z.; Heitner, C.; McGarry, P.; "Photostabilization of bleached mechanical pulps with DTPA treatment"; Journal of Pulp and Paper Science; Vol./Issue 24(8); pp. 259-263; 1998.

Ni, Y.; Li, Z.; van Heiningen, A.R.P.; "Minimization of the brightness loss due to metal ions in process water for bleached mechanical pulps"; Pulp & Paper Canada; 98(10); pp. T396-T399; Oct. 1997.

Bouchard, J.; Polverari, M.; Morelli, E.; Gagnon P.; Picotte, R.; "Brightness reversion and brightness loss in fully-bleached kraft pulp: a case study"; Pulp & Paper Canada; 101(8); pp. T232-T236; Aug. 2000.

Kuchinskaya, O. A.; D'Yachenko, Yu. I.; Tumanova, T.A.; Puzyrev, S.S.; (Leningr. Lesotekh. Inst., Leningrad USSR).; "Decrease in brightnetss reversion of thermomechnical pulp bleached by hydrogen peroxide."; Izv. Vyssh. Uchebn. Zaved., Lesn. Zh.; (6); pp. 80-85; 1990; English Abstract only.

Davidson, R.S., et al.; A study of the photoyellowing of paper made from bleached CTMP; Journal of Wood Chemistry and Technology; 11(4) pp. 419-437, especially pp. 422, 428 and 433; 1991.

* cited by examiner

*Primary Examiner* — Anthony Calandra

(74) *Attorney, Agent, or Firm* — Benjamin E. Carlsen; Michael B. Martin

(57) ABSTRACT

Compositions and processes that preserve and enhance the brightness and improve color of pulp or paper when applied during different stages of the papermaking process are identified. The composition and method maintains and/or enhances brightness, prevent yellowing, and enhances the performance of paper products. Used in combination with optical brighteners and/or chelants the described agents produce a synergistic effect not previously identified in the paper process.

25 Claims, No Drawings

METHODS FOR ENHANCING BRIGHTNESS AND RESISTANCE TO THERMAL YELLOWING OF BLEACHED KRAFT PULP AND PAPER

CROSS REFERENCE TO RELATED APPLICATIONS

This applications claims benefit of provisional application Nos. 60/721,847, Sep. 29, 2005 and 60/718,475, Sep. 19, 2005.

TECHNICAL FIELD

This invention relates to compositions and processes for improving brightness and optical properties, preventing loss of brightness and for enhancing resistance to thermal yellowing in pulp and paper manufacture. More particularly, this invention concerns compositions, which either alone or in the presence of optical brightening agents effectively enhance the brightness and optical properties of a paper product as well as increase its thermal stability.

BACKGROUND OF THE INVENTION

Pulps produced by either mechanical or chemical pulping methods possess a color that can range from dark brown to creamish depending on the wood type and defibering process used. The pulp is bleached to produce white paper products for a multiplicity of applications.

Bleaching is the removal or alteration of those light-absorbing substances found in unbleached pulp. In the bleaching of mechanical pulp, the object is to decolorize the pulp without solubilizing the lignin. Either reducing (e.g. sodium hydrosulfite) or oxidizing (e.g., hydrogen peroxide) bleaching agents are usually used. The bleaching is often a multistage process. The bleaching of chemical pulps is an extension of the delignification that started in the digestion stage. The bleaching is often a multistage process, which stages may include chlorine dioxide bleaching, oxygen-alkaline delignification, and peroxide bleaching.

Discoloration, mostly ascribed to thermal aging, results in yellowing and brightness loss in various stages of papermaking processes employing bleached pulp and in the resultant paper products. The industry invests significantly in chemicals such as bleaching agents and optical brighteners that improve optical properties of the finished paper or paper products. To date, however, the results have been less than satisfactory and the economic losses resulting from discoloration and yellowing present significant ongoing challenges to the industry. Accordingly, there remains a need for a successful and practical solution to loss of brightness and undesirable yellowing of pulp and paper.

SUMMARY OF THE INVENTION

The present invention provides compositions and methods for improving and stabilizing brightness and enhancing resistance to yellowing in the papermaking process.

In an aspect, this invention is a method of preparing a bleached pulp material having enhanced brightness and enhanced resistance to thermal yellowing comprising (1) providing a bleached pulp material; and (2) contacting the bleached pulp material with an effective amount of one or more reducing agents.

In another aspect, this invention is a method of making a paper product having enhanced brightness and resistance to thermal yellowing comprising (1) providing a bleached pulp; (2) forming an aqueous stock suspension comprising bleached pulp; (3) draining the stock suspension to form a sheet; and (4) drying the sheet to form the paper product, wherein an effective amount of one or more reducing agents is added to the bleached pulp, to the stock suspension or on to the sheet.

In another aspect, this invention is a method of preventing brightness loss and yellowing of a bleached pulp material during storage comprising adding an effective amount of one or more reducing agents and optionally one or more chelants and one or more polycarboxylates to the bleached pulp material.

In another aspect, this invention is a bleached pulp material which comprises the mixed product of bleached pulp and an effective amount of one or more reducing agents, wherein said bleached pulp material has a higher brightness and enhanced resistance to thermal yellowing, when compared with similar pulp not treated with said reducing agents.

Applicant has also discovered that reducing agents in combination with chelants effectively enhances the brightness of paper products and further that reducing agents used in combination with optical brighteners enhance the effect of the optical brighteners and improve color scheme. Accordingly, in additional aspects, this invention is methods of using reducing agents in combination with chelants and/or optical brighteners to prepare bleached pulp materials having higher brightness, enhanced resistance to thermal yellowing and improved color schemes.

The reducing agent, optical brighteners and chelants may be used alone or in combination with known additives to enhance the quality of the desired paper product.

DETAILED DESCRIPTION OF THE INVENTION

The present invention provides an improved process for making paper and paper products exhibiting high optical brightness. Brightness stabilization against thermal yellowing, color improvement and brightness enhancement of bleached pulp and paper product prepared from the bleached pulp can be achieved by adding one or more reducing agents as defined herein to pulp, paper, paperboard or tissue anywhere in the papermaking process.

Brightness is a term used to describe the whiteness of pulp or paper, on a scale from 0% (absolute black) to 100% (relative to a MgO standard, which has an absolute brightness of about 96%) by the reflectance of blue light (457 nm) from the paper. "Thermal brightness loss" is a brightness loss in paper and pulp under the influence of time, temperature and moisture (non-photochemical brightness loss). "Brightness loss during storage" is thermal brightness loss over time under storage conditions.

Yellowing of a bleached pulp material (brightness reversion) is the loss of brightness of bleached pulp, paper, paperboard, paper tissue and related materials prepared from the bleached pulp over a period of time.

The reducing agents described herein are suitable for use on any bleached pulp material used in papermaking processes and any paper product prepared from the bleached pulp. As used herein, "bleached pulp material" means bleached pulp and paper products prepared from the bleached pulp including paper, paperboard, tissue, and the like.

Reducing Agents according to this invention include chemical substances capable of transform functional groups in the bleached pulp from a higher oxidation category to a lower oxidation category. The benefits of this transformation include increased brightness stability in the paper machine and enhanced performance of optical brighteners.

In an embodiment, the reducing agents are selected from the group consisting of sulfites, bisulfites, metabisulfites (pyrosulfites), sulfoxylates, thiosulfates, dithionites (hydrosulfites), polythionates, formamidinesulfinic acid and salts and derivatives thereof, formaldehyde bisulfite adduct and other aldehyde bisulfite adducts, sulfinamides and ethers of sulfinic acid, sulfenamides and ethers of sulfenic acid, sulfamides, phosphines, phosphonium salts, phosphites, and thiophosphites.

As used herein, "sulfites" means dibasic metal salts of sulfurous acid, $H_2SO_3$, including dibasic alkali and alkaline earth metal salts such as sodium sulfite ($Na_2SO_3$), calcium sulfite ($CaSO_3$), and the like.

"Bisulfites" means monobasic metal salts of sulfurous acid, $H_2SO_3$, including alkali and alkaline earth metal monobasic salts such as sodium bisulfite ($NaHSO_3$), magnesium bisulfite ($Mg(HSO_3)_2$), and the like.

"Sulfoxylates" means salts of sulfoxylic acid, $H_2SO_2$, including zinc sulfoxylate ($ZnSO_2$), and the like.

"Metabisulfites (Pyrosulfites)" means salts of pyrosulfurous acid, $H_2S_2O_5$, including sodium metabisulfite ($Na_2S_2O_5$), and the like.

"Thiosulfates" means salts of thiosulfurous acid, $H_2S_2O_3$, including potassium thiosulfate ($Na_2S_2O_3$), and the like.

"Polythionates" means salts of polythionic acid, $H_2S_nO_6$ (n=2-6), including sodium trithionate ($Na_2S_3O_6$), salts of dithionic acid, $H_2S_2O_6$, such as sodium dithionate $Na_2S_2O_6$, and the like.

"Dithionites (hydrosulfites)" means salts of dithionous (hydrosulfurous, hyposulfurous) acid, $H_2S_2O_4$, including sodium dithionite (hydrosulfite) ($Na_2S_2O_4$), magnesium dithionite ($MgS_2O_4$), and the like.

"Formamidinesulfinic acid (FAS)" means a compound of formula $H_2NC(=NH)SO_2H$ and its salts and derivatives including the sodium salt $H_2NC(=NH)SO_2Na$.

"Aldehyde bisulfite adducts" means compounds of formula $R1CH(OH)SO_3H$ and metal salts thereof where $R_1$ is selected from alkyl, alkenyl, aryl and arylalkyl. Representative aldehyde bisulfite adducts include formaldehyde bisulfite adduct $HOCH_2SO_3Na$, and the like.

"Sulfinamides and ethers of sulfinic acid" means compounds of formula $R_1$—S(=O)—$R_2$, where $R_1$ is defined herein and $R_2$ is selected from $OR_3$ and $NR_4R_5$, where $R_3$-$R_5$ are independently selected from selected from alkyl, alkenyl, aryl and arylalkyl. Representative sulfinamides include ethylsulfindimethylamide ($CH_3CH_2S(=O)N(CH_3)_2$), and the like.

"Sulfenamides and ethers of sulfenic acid" means compounds of formula $R_1$-S—$R_2$, where $R_1$ and $R_2$ are defined above. Representative sulfenamides include ethylsulfendimethylamide ($CH_3CH_2SN(CH_3)_2$), and the like.

"Sulfamides" means compounds of formula $R_1$—C(=S)—$NR_4R_5$, where $R_1$, $R_4$ and $R_5$ are defined above. Representative sulfamides include $CH_3CH_2C(=S)N(CH_3)_2$, and the like.

"Phosphines" means derivatives of phosphine, $PH_3$, normally organic substituted phosphines of the formula $R_6R_7R_8P$ where $R_6$-$R_8$ are independently selected from H, alkyl, alkenyl, aryl, arylalkyl and $NR_4R_5$ where $R_4$ and $R_5$ is defined above. Representative phosphines include $(HOCH_2)_3P$ (THP), and the like.

"Phosphites" means derivatives of phosphorous acid $P(OH)_3$, including organic substituted phosphites of the formula $(R_3O)(R_4O)(R_5O)P$ where $R_3$-$R_5$ are defined above. Representative phosphites include $(CH_3CH_2O)_3P$, and the like.

"Thiophosphites" means derivatives of phosphorothious acid $HSP(OH)_2$, including organic substituted thiophosphites of formula $(R_3O)(R_4O)(R_5S)P$ where $R_3$-$R_5$ are defined above. Representative thiophosphites include $(CH_3CH_2O)_2(CH_3CH_2S)P$, and the like.

"Phosphonium salts" means organic substituted phosphines of the formula $R_1R_3R_4R_5P^+X^-$, where $R_1$ and $R_4$-$R_5$ are as defined above and X is any organic or inorganic anion. Representative phosphonium salts include $(HO_2CCH_2CH_2)_3P^+HCl^-$(THP), $[(HOCH_2)_4P^+]_2(SO_4)^{2-}$(BTHP), and the like.

"Alkenyl" means a monovalent group derived from a straight or branched hydrocarbon containing at least one carbon-carbon double bond by the removal of a single hydrogen atom. The alkenyl may be unsubstituted or substituted with one or more groups selected from amino, alkoxy, hydroxy and halogen.

"Alkoxy" means an alkyl group attached to the parent molecular moiety through an oxygen atom. Representative alkoxy groups include methoxy, ethoxy, propoxy, butoxy, and the like. Methoxy and ethoxy are preferred.

"Alkyl" means a monovalent group derived from a straight or branched chain saturated hydrocarbon by the removal of a single hydrogen atom. The alkyl may be unsubstituted or substituted with one or more groups selected from amino, alkoxy, hydroxy and halogen. Representative alkyl groups include methyl, ethyl, n- and iso-propyl, n-, sec-, iso- and tert-butyl, and the like.

"Alkylene" means a divalent group derived from a straight or branched chain saturated hydrocarbon by the removal of two hydrogen atoms, for example methylene, 1,2-ethylene, 1,1-ethylene, 1,3-propylene, 2,2-dimethylpropylene, and the like.

"Amino" means a group of formula —$NY_1Y_2$ where $Y_1$ and $Y_2$ are independently selected from H, alkyl, alkenyl, aryl and arylalkyl. Representative amino groups include amino (—$NH_2$), methylamino, ethylamino, isopropylamino, diethylamino, dimethylamino, methylethylamino, and the like.

"Aryl" means aromatic carbocyclic radicals and heterocyclic radicals having about 5 to about 14 ring atoms. The aryl may be unsubstituted or substituted with one or more groups selected from amino, alkoxy, hydroxy and halogen. Representative aryl include phenyl, naphthyl, phenanthryl, anthracyl, pyridyl, furyl, pyrrolyl, quinolyl, thienyl, thiazolyl, pyrimidyl, indolyl, and the like. "Arylalkyl" means an aryl group attached to the parent molecular moiety through an alkylene group. Representative arylalkyl groups include benzyl, 2-phenylethyl, and the like.

"Halo" and "halogen" mean chlorine, fluorine, bromine and iodine.

"Salt" means the metal, ammonium, substituted ammonium or phosphonium salt of an inorganic or organic anionic counterion. Representative metals include sodium, lithium, potassium, calcium, magnesium, and the like. Representative anionic counterions include sulfite, bisulfite, sulfoxylate, metabisulfite, thiosulfate, polythionate, hydrosulfite, formamidinesulfinate, and the like.

In an embodiment, the reducing agent is selected from the group consisting of substituted phosphines, sulfites, bisulfites and metabisulfites.

In an embodiment, the reducing agent is sodium bisulfite.

The process of the present invention can be practiced on conventional papermaking equipment. Although papermaking equipment varies in operation and mechanical design, the processes by which paper is made on different equipment contain common stages. Papermaking typically includes a pulping stage, bleaching stage, stock preparation stage, a wet end stage and a dry end stage.

In the pulping stage, individual cellulose fibers are liberated from a source of cellulose either by mechanical or chemical action, or both. Representative sources of cellulose include, but are not limited to, wood and similar "woody" plants, soy, rice, cotton, straw, flax, abaca, hemp, bagasse, lignin-containing plants, and the like, as well as original and recycled paper, paper tissue and paperboard. Such pulps include, but are not limited to, groundwood (GWD), bleached groundwood, thermomechanical pulps (TMP), bleached thermomechanical pulps, chemi-thermomechanical pulps (CTMP), bleached chemi-thermomechanical pulps, deinked pulps, kraft pulps, bleached kraft pulps, sulfite pulps, and bleached sulfite pulps. Recycled pulps may or may not be bleached in the recycling stage, but they are presumed to be originally bleached. Any of the pulps described above which have not previously been subjected to bleaching may be bleached as described herein to provide a bleached pulp material.

In an embodiment, the bleached pulp material is selected from the group consisting of virgin pulp, recycled pulp, kraft, sulfite pulp, mechanical pulp, any combination of such pulps, recycled paper, paper tissue, and any paper made from such listed pulps or combinations thereof.

A further advantage of this invention is that it allows for substituting lower-priced mechanical pulp for higher priced kraft in printing grade kraft-mechanical paper. Use of the chemistry and methods described herein increases the brightness and stability toward yellowing, therefore permitting the use of higher amounts of mechanical pulp, with corresponding reduction in cost, without loss of quality in the resulting paper product.

The pulp, is suspended in water in the stock preparation stage. Additives such as brightening agents, dyes, pigments, fillers, antimicrobial agents, defoamers, pH control agents and drainage aids also may be added to the stock at this stage. As the term is used in this disclosure, "stock preparation" includes such operations as dilution, screening and cleaning of the stock suspension that may occur prior to forming of the web.

The wet end stage of the papermaking process comprises depositing the stock suspension or pulp slurry on the wire or felt of the papermaking machine to form a continuous web of fibers, draining of the web and consolidation of the web ("pressing") to form a sheet. Any papermaking machine known in the art is suitable for use with the process of the present invention. Such machines may include cylinder machines, fourdrinier machines, twin wire forming machines, tissue machines, and the like, and modifications thereof.

In the dry end stage of the papermaking process, the web is dried and may be subjected to additional processing like size pressing, calendering, spray coating with surface modifiers, printing, cutting, corrugating and the like. In addition to a size press and calender waterbox, the dried paper can be coated by spray coating using a sprayboom.

Applicant has also discovered that reducing agents in combination with chelants as described below effectively enhance the brightness of a paper product via increased thermal stability of the pulp and reduction of chromophoric structures in pulp.

In an embodiment, one or more chelants are added to the bleached pulp or paper product. Suitable chelants according to this embodiment include compounds that are capable of chelating transitional metals that form colored products with pulp constituents and catalyze color-forming reactions in the bleached pulp or paper products.

In an embodiment, the chelant is a compound selected from the group consisting of organic phosphonate, phosphate, carboxylic acids, dithiocarbamates, salts of any of the previous members, and any combination thereof.

"Organic phosphonates" means organic derivatives of phosphonic acid, $HP(O)(OH)_2$, containing a single C—P bond, such as HEDP ($CH_3C(OH)(P(O)(OH)_2)$, 1-hydroxy-1,3-propanediylbis-phosphonic acid ($(HO)_2P(O)CH(OH)CH_2CH_2P(O)(OH)_2)$); preferably containing a single C—N bond adjacent (vicinal) to the C—P bond, such as DTMPA ($(HO)_2P(O)CH_2N[CH_2CH_2N(CH_2P(O)(OH)_2)_2]_2$), AMP ($N(CH_2P(O)(OH)_2)_3$), PAPEMP ($(HO)_2P(O)CH_2)_2NCH(CH_3)CH_2(OCH_2CH(CH_3))_2N(CH_2)_6N(CH_2P(O)(OH)_2)_2$), HMDTMP ($(HO)_2P(O)CH_2)_2N(CH_2)_6N(CH_2P(O)(OH)_2)_2$), HEBMP ($N(CH_2P(O)(OH)_2)_2CH_2CH_2OH$), and the like.

"Organic phosphates" means organic derivatives of phosphorous acid, $P(O)(OH)_3$, containing a single C—P bond, including triethanolamine tri(phosphate ester) ($N(CH_2CH_2OP(O)(OH)_2)_3$), and the like.

"Carboxylic acids" means organic compounds containing one or more carboxylic group(s), —C(O)OH, preferably aminocarboxylic acids containing a single C—N bond adjacent (vicinal) to the $C—CO_2H$ bond, such as EDTA ($(HO_2CCH_2)_2NCH_2CH_2N(CH_2CO_2H)_2$), DTPA ($(HO_2CCH_2)_2NCH_2CH_2N(CH_2CO_2H)CH_2CH_2N(CH_2CO_2H)_2$), and the like and alkaline and alkaline earth metal salts thereof.

"Dithiocarbamates" include monomeric dithiocarbamates, polymeric dithiocarbamates, polydiallylamine dithiocarbamates, 2,4,6-trimercapto-1,3,5-triazine, disodium ethylenebis-dithiocarbamate, disodium dimethyldithiocarbamate, and the like.

In an embodiment, the chelant is a phosphonate.

In an embodiment, the phosphonate is diethylene-triamine-pentamethylene phosphonic acid (DTMPA) and salts thereof.

In an embodiment, the chelant is a carboxylic acid.

In an embodiment, the carboxylate is selected from diethylenetriaminepentaacetic acid (DTPA) and salts thereof and ethylenediaminetetraacetic acid (EDTA) and salts thereof.

Applicant has also discovered that reducing agents used in combination with optical brighteners ("OBA's") enhance the effect of optical brighteners (OBA). The reducing agents also improve the color scheme. This permits reduction of the amount of OBA's and brighteners such as blue dyes necessary to achieve comparable brightness and color. Replacing some of the OBA and dyes with reducing agents allows pulp and paper manufacturers to reduce production costs and reduce the overall amount of OBA and dyes present, while maintaining an acceptable level of brightness in the paper product and achieving the target color. In some cases it may be possible to eliminate dyes entirely and maintain color.

Accordingly, in another embodiment, one or more optical brighteners ("OBA's") are added to the bleached pulp or paper product.

"Optical brighteners" are fluorescent dyes or pigments that absorb ultraviolet radiation and reemit it at a higher frequency in the visible spectrum (blue), thereby effecting a white, bright appearance to the paper sheet when added to the stock furnish. Representative optical brighteners include, but are not limited to azoles, biphenyls, coumarins; furans; ionic brighteners, including anionic, cationic, and anionic (neutral) compounds, such as the Eccobrite® and Eccowhite® compounds available from Eastern Color & Chemical Co. (Providence, R.I.); naphthalimides; pyrazenes; substituted (e.g., sulfonated) stilbenes, such as the Leucophor® range of optical brighteners available from the Clariant Corporation (Muttenz, Switzerland), and Tinopal® from Ciba Specialty Chemicals (Basel, Switzerland); salts of such compounds including but not limited to alkali metal salts, alkaline earth metal salts, transition metal salts, organic salts and ammonium salts of such brightening agents; and combinations of one or more of the foregoing agents.

In an embodiment, the optical brighteners are selected from the group of disulfonated, tetrasulfonated and hexasulfonated Tinopal® OBAs.

The dosage of reducing agents, chelants and/or optical brighteners is the amount necessary to achieve the desired brightness and resistance to yellowing of the bleached pulp or paper product prepared from the bleached pulp and can be readily determined by one of skill in the art based on the characteristics of chelant or optical brightener, the pulp or paper being treated and the method of application.

The effective amount of reducing agent added to the bleached pulp or paper product is the amount of reducing agent which enhances the brightness and resistance to thermal yellowing of the pulp or paper compared to pulp or paper which is not treated with the reducing agents. Methods for determining brightness and resistance to thermal yellowing are described herein.

Typically, about 0.005 to about 2, preferably about 0.05 to about 0.25 weight percent, based on oven-dried pulp of reducing agent is added to the bleached pulp or paper product.

In a typical application, about 0.001 to about 1, preferably about 0.01 to about 0.1 weight percent of phosphonate, phosphate or carboxylic acid chelant and/or about 0.002 to about 0.02 weight percent of dithiocarbamates chelant based on oven-dried pulp is added to the bleached pulp or paper product.

Optical brighteners are typically added in amounts of about 0.005 to about 2, preferably 0.05 to about 1 weight percent of optical brightener based on oven-dried pulp.

The reducing agents, chelants and/or optical brighteners can be added to bleached pulp or paper at any point in the papermaking or tissue making process. Representative addition points include, but are not limited to (a) to the pulp slurry in the latency chest; (b) to the pulp after the bleaching stage in a storage, blending or transfer chest; (c) to pulp after bleaching, washing and dewatering followed by cylinder or flash drying; (d) before or after the cleaners; (e) before or after the fan pump to the paper machine headbox; (f) to the paper machine white water; (g) to the silo or save all; (h) in the press section using, for example, a size press, coater or spray bar; (i) in the drying section using, for example, a size press, coater or spray bar; (j) on the calender using a wafer box; and/or (k) on paper in an off-machine coater or size press; and/or (l) in the curl control unit.

The precise location where the reducing agents, chelants and/or optical brighteners should be added will depend on the specific equipment involved, the exact process conditions being used and the like. In some cases, the reducing agents, chelants and/or optical brighteners may be added at one or more locations for optimal effectiveness.

Application can be by any means conventionally used in papermaking processes, including by "split-feeding" whereby a portion of the reducing agent, chelant and/or optical brightener is applied at one point in the papermaking process, for example on pulp or a wet sheet (before the dryers) and the remaining portion is added at a subsequent point, for example in the size press.

The chelant and/or optical brightener can be added to the bleached pulp or paper product before, after or simultaneously with the reducing agent. The optical brightener and/or chelant may also be formulated with the reducing agent.

In an embodiment, one or more reducing agents and one or more optical brighteners are mixed with the surface sizing solution and applied in the size press.

In an embodiment, the reducing agent is added to bleached pulp after the bleaching stage in the storage, blending or transfer chest.

At these various locations, the reducing agents, chelants and/or optical brighteners can also be added with a carrier or additive typically used in paper making, such as retention aids, sizing aids and solutions, starches, precipitated calcium carbonate, ground calcium carbonate, or other clays or fillers, and brightening additives.

In an embodiment, the reducing agents, chelants and/or optical brighteners are used in combination with one or more partially neutralized polycarboxylic acids, preferably polycarboxylic acids such as polyacrylic acid $(CH_3CH(CO_2H)[CH_2CH(CO_2H)]_nCH_2CH_2CO_2H$, where n is about 10 to about 50,000. The polycarboxylic acid may be neutralized to the target pH, (typically 5-6 as discussed below) with alkali such as sodium hydroxide.

In an embodiment, this invention is a formulation comprising one or more chelants, one or more reducing agents and one or more polycarboxylic acids. The formulation preferably has a pH of about 4-7, more preferably about 5-6.

In an embodiment, this invention is a formulation comprising one or more reducing agents and one or more optical brighteners and optionally one or more chelants or one or more polycarboxylates, or combinations thereof. Formulations according to this embodiment preferably have a pH of about 7-11, more preferably about 9-10.

The reducing agents, chelants and optical brighteners and polycarboxylates may be used in addition to other additives conventionally used in papermaking to improve one or more properties of the finished paper product, assist in the process of manufacturing the paper itself, or both. These additives are generally characterized as either functional additives or control additives.

Functional additives are typically those additives that are use to improve or impart certain specifically desired properties to the final paper product and include but are not limited to brightening agents, dyes, fillers, sizing agents, starches, and adhesives.

Control additives, on the other hand, are additives incorporated during the process of manufacturing the paper so as to improve the overall process without significantly affecting the physical properties of the paper. Control additives include biocides, retention aids, defoamers, pH control agents, pitch control agents, and drainage aids. Paper and paper products made using the process of the present invention may contain one or more functional additives and/or control additives.

Pigments and dyes impart color to paper. Dyes include organic compounds having conjugated double bond systems; azo compounds; metallic azo compounds; anthraquinones; triaryl compounds, such as triarylmethane; quinoline and related compounds; acidic dyes (anionic organic dyes containing sulfonate groups, used with organic rations such as alum); basic dyes (cationic organic dyes containing amine functional groups); and direct dyes (acid-type dyes having high molecular weights and a specific, direct affinity for cellulose); as well as combinations of the above-listed suitable dye compounds. Pigments are finely divided mineral that can be either white or colored. The pigments that are most commonly used in the papermaking industry are clay, calcium carbonate and titanium dioxide.

Fillers, are added to paper to increase opacity and brightness. Fillers include but are not limited to calcium carbonate (calcite); precipitated calcium carbonate (PCC); calcium sulfate (including the various hydrated forms); calcium aluminate; zinc oxides; magnesium silicates, such as talc; titanium dioxide ($TiO_2$), such as anatase or rutile; clay, or kaolin, consisting of hydrated $SiO_2$ and $Al_2O_3$; synthetic clay; mica; vermiculite; inorganic aggregates; perlite; sand; gravel; sandstone; glass beads; aerogels; xerogels; seagel; fly ash; alumina; microspheres; hollow glass spheres; porous ceramic spheres; cork; seeds; lightweight polymers; xonotlite (a crystalline calcium silicate gel); pumice; exfoliated rock; waste concrete products; partially hydrated or unhydrated hydraulic cement particles; and diatomaceous earth, as well as combinations of such compounds.

Sizing agents are added to the paper during the manufacturing process to aid in the development of a resistance to penetration of liquids through the paper. Sizing agents can be internal sizing agents or external (surface) sizing agents, and can be used for hard-sizing, slack-sizing, or both methods of sizing. More specifically, sizing agents include rosin; rosin precipitated with alum ($Al_2(SO_4)_3$); abietic acid and abietic acid homologues such as neoabietic acid and levopimaric acid; stearic acid and stearic acid derivatives; ammonium zirconium carbonate; silicone and silicone-containing compounds, such as RE-29 available from GE-OSI and SM-8715, available from Dow Corning Corporation (Midland, Mich.); fluorochemicals of the general structure $CF_3(CF_2)_nR$, wherein R is anionic, cationic or another functional group, such as Gortex; alkylketene dimer (AKD), such as Aquapel 364, Aquapel (I 752, Heron) 70, Hercon 79, Precise 787, Precise 2000, and Precise 3000, all of which are commercially available from Hercules, Incorporated (Willmington, Del.); and alkyl succinic anhydride (ASA); emulsions of ASA or AKD with cationic starch; ASA incorporating alum; starch; hydroxymethyl starch; carboxymethylcellulose (CMC); polyvinyl alcohol; methyl cellulose; alginates; waxes; wax emulsions; and combinations of such sizing agents.

Starch has many uses in papermaking. For example, it functions as a retention agent, dry-strength agent and surface sizing agent. Starches include but are not limited to amylose; amylopectin; starches containing various amounts of amylose and amylopectin, such as 25% amylose and 75% amylopectin (corn starch) and 20% amylose and 80% amylopectin (potato starch); enzymatically treated starches; hydrolyzed starches; heated starches, also known in the art as "pasted starches"; cationic starches, such as those resulting from the reaction of a starch with a tertiary amine to form a quaternary ammonium salt; anionic starches; ampholytic starches (containing both cationic and anionic functionalities); cellulose and cellulose derived compounds; and combinations of these compounds.

The method of this invention yields paper products with a bright surface. Moreover, the novel composition further protects paper from long-term discoloration during regular use.

The foregoing may be better understood by reference to the following examples, which are presented for purposes of illustration and are not intended to limit the scope of the invention.

TABLE 1

Representative Compositions (water not included)

| | Component | % Component |
|---|---|---|
| Composition A | DTMPA | 7.6 |
| | Sodium polyacrylate | 3.5 |
| | NaOH | 1.5 |
| | Sodium Metabisulfite | 26.6 |
| Composition B | DTMPA | 9.0 |
| | NaOH | 3.6 |
| | Sodium Metabisulfite | 27 |

TABLE 1-continued

Representative Compositions (water not included)

| | Component | % Component |
|---|---|---|
| Composition C | DTMPA | 6.0 |
| | NaOH | 3.0 |
| | Sodium Metabisulfite | 30 |
| Composition D | DTMPA | 5.0 |
| | DTPA | 4.1 |
| | NaOH | 1.5 |
| | Sodium Metabisulfite | 30 |
| Composition E | DTMPA | 7.4 |
| | NaOH | 5.5 |
| | Sodium Metabisulfite | 16.7 |
| | FAS | 7.7 |
| Composition F | DTMPA | 4.2 |
| | NaOH | 2.8 |
| | Sodium Metabisulfite | 19.9 |
| | THPS | 9.8 |
| | DTPA | 4.1 |
| | $NaNO_2$ | 0.1 |
| Composition G | DTPA | 2.9 |
| | Sodium polyacrylate | 1.0 |
| | NaOH | 1.3 |
| | Sodium Metabisulfite | 30.0 |

EXAMPLES

In these Examples, sufficient 50% aqueous sodium hydroxide was added to achieve appropriate pH for the agent or composition being tested. All percentages in these examples are given on a weight percent dry pulp basis.

In these Examples, the following terms shall have the indicated meaning. Br for ISO brightness R457 (TAPPI 525); Ye for E313 yellowness; Im Br for R457 brightness after the application; TA Br for R457 brightness after thermal aging; TA loss for loss in brightness after thermal aging; % Inh. for % Inhibition of brightness loss: % Inh.=100-100*(ImBr-TABr)/$(\text{ImBr-TABr})_{control}$; WI for E313 Whiteness: TMP for thermomechanical pulp; CTMP for chemi-thermomechanical pulp; RMP for refiner mechanical pulp; OBA for optical brightener; FAS for formamidinesulfinic acid; TCP for $(HOCH_2CH_2)_3PHCl$, tris-carboxyethylphosphonium hydrochloride; BTHP for $[(HOCH_2)_4P]_2(SO_4)$, tetra-hydroxymethylphosphonium sulfate; THP for $(HOCH_2)_3P$, tris-hydroxymethylphosphine; EDTA for $(HO_2CCH_2)_2NCH_2CH_2N(CH_2CO_2H)_2$, ethylenediaminetetraacetic acid; DTPA for $(HO_2CCH_2)_2NCH_2CH_2N(CH_2CO_2H)CH_2CH_2N(CH_2CO_2H)_2$, diethylenetriaminepentaacetic acid; DTMPA for $H_2O_3PCH_2N[CH_2CH_2N(CH_2PO_3H_2)_2]_2$, diethylene-triamine-pentamethylene phosphonic acid; and DTC for sodium dimethyldithiocarbamate.

Treatment

Handsheets were made of bleached pulp and then used in the experiments, in which the reducing agents were applied either on a wet sheet (before or after the press) before drum-drying or after drum-drying (temperature during drum drying: 100° C.). The third option was split-feed application. The surface sizing application was followed by one more round on a drum dryer.

The load of the tested Agent or Composition solution was determined based on the dry weight of the pulp sample. The Agent or Composition solutions were applied using a rod, as uniformly as possible, as solutions in water. The test sheets were dried using a laboratory drum drier under uniform conditions (one round) and then, after measuring the brightness, subjected to the accelerated aging tests as described below.

Brightness Reversion Experiments (Thermal Aging, Paper):

The 3×9 cm samples cut out of test sheets were kept in a water bath at 70° C., 100% humidity for about 3 days. The samples were equilibrated in a constant humidity room before measuring brightness.

Brightness Reversion Experiments (Thermal Aging, Pulp):

The pulp samples (10% consistency, 5 g pulp on o.d. base) were sealed in plastic bags and kept in a water bath at 70° C. for 3-6 hours. Handsheets were prepared and equilibrated in a constant humidity room before measuring brightness.

Test Equipment:

Laboratory drum drier.

"Elrepho 3000," "Technidyne Color Touch 2 (Model ISO)" or another instrument for brightness measurements.

Hitachi F-4500 fluorescence spectrometer or another instrument for relative fluorescence intensity measurements.

Micropipette.

Surface size application kit (pad and size 3-application rod).

Constant humidity room (23° C., 50% humidity).

Water bath/thermostat accommodating a floating plastic box with paper samples 100-mL application cuvette for the soaking method.

Dry Surface Application Procedure (Surface Sizing):

1. Prepare 8×8-inch hand sheet according to the standard procedure. The target dry weight is 2.5 g. Pass wet hand sheets through one cycle on the drum dryer.
2. Cut the sheets into 4 smaller squares (approximate wt of 0.625 g each).
3. Tape one side of the smaller square (test sheet) to a glass pad using Scotch tape of length greater than the side of the sheet.
4. The application rod is placed on the scotch tape and a volume of 0.2 ml of the mix is applied on the tape against the rod using a micropipette.
5. The agent solution is applied in such away that it is evenly distributed on the tape to cover the entire test sheet.
6. Quickly draw the solution from the tape over sheet using the rod so that the reducing agent compound solution is evenly applied on to the entire sheet.
7. Drum-dry the test sheet and equilibrate at room temperature.
8. Measure brightness and yellowness.

Dry Surface Application Procedure (Surface Sizing, Soaking Method):

1. Prepare 8×8-inch hand sheet according to the standard procedure. The target dry weight is 2.5 g. Pass wet hand sheets through one cycle on the drum dryer.
2. Cut ⅛th strip of the sheet (0.31 g).
3. In a 50 ml test tube, prepare solutions of pre-cooked starch (if needed) and reducing agent compound solutions based on the pre-determined pickup rate and target dose.
4. Dip the paper strip into the solution for 10 seconds, let it drip for 35 seconds and then pass it through the press.
5. Drum-dry the test sheet and equilibrate at room temperature.
6. Measure brightness and yellowness.

Wet End Application Procedure:

1. An 8×8-inch sheet is made and dewatered using the press with two blotters at the bottom and one blotter on top. The consistency of the pressed sheet is around 40%.
2. The top blotter and the bottom most blotter are removed from the sheet after the press.
3. The sheet along with one bottom blotter are cut into 4 smaller test sheets of equal size (approximate dry weight of the sheet is 0.625 g).
4. The test sheet is taped along with the blotter to the glass pad as described in the "dry surface application procedure."
5. Solution 1 is applied as described in the dry surface application procedure.
6. After application, the test sheet along with the wet blotter is removed from the glass pad, the tape is removed and the blotter is separated from the test sheet. The blotter is discarded.
7. The test sheet is then drum dried and equilibrated at room temperature.

Split Feed Application Procedure:

1. An 8×8-inch sheet is made according to the standard procedure.
2. The sheet formed on the screen is then padded with 4 blotters.
3. The sheet along with blotters is then couched using a heavy metal roller. This process removes excess water from the sheet to increase the consistency of the sheet to around 20%.
4. Three top blotters are removed from the sheet.
5. The sheet and one blotter are then removed from the screen and cut into 4 smaller pieces as described in the "Wet end Application Procedure".
6. The sheet and the blotter are then taped to the glass pad as described in the "Wet end Application Procedure".
7. Solution 2 is applied as described in the "Wet end Application Procedure".
8. The test sheet is then pressed with 2 blotters on each side.
9. After press, all the blotters are removed and the sheet is drum dried.

Solution 2 is then applied to the sheet, dried and measured as described in steps 3 to 8 of "Dry Surface Application Procedure".

Pulp Application Procedure:

The chemicals were added directly to the pulp (thin stock or thick stock) and mixed with the pulp in sealed bags. In a pulp application procedure for OBA enhancement the chemicals were added directly to the bleached kraft pulp at 20% consistency, mixed with the pulp in sealed bags and kept at 45-80° C. for 30 min. The pulp was diluted to 5% consistency, the OBA was added, mixed with the pulp, and the slurry was kept at 50° C. for 20 min. Then the slurry was further diluted and hand sheets prepared according to the standard procedure.

Testing Results

1. Mill Trial

The trial data were collected at a Southern kraft mill. The table below gives sample data. In several tests, application of the product (Composition A) in a size press, with an OBA in the sizing solution, at 5 lb/t and higher doses consistently provided a 1.5-point brightness increase accompanied by improved color of the paper sheet (reflected in decreasing DE values). Returning to the standard mill conditions (no penetrant composition applied) resulted in a decrease of brightness to the background level. This experiment was reproduced three times.

TABLE 2

Trial Data: R457 Brightness, E313 Whiteness, $DE(\Delta E) = Sq.rt.[(L_0 - L)^2 + (a_0 - a)^2 + (b_0 - b)^2]$

| Time, h. | Dose, lb/t | Brightness | DE | WI E313 |
|---|---|---|---|---|
| 0 | 0 | 94.5 | 1.99 | 142.24 |
| 0.58 | 0 | 94.5 | 1.61 | 144.95 |
| 1.17 | 0 | 94.5 | 1.83 | 143.34 |
| 1.75 | 0 | 94.5 | 1.93 | 143.52 |
| 2.33 | 0 | 94.5 | 1.52 | 146.66 |
| 2.92 | 4 | 95.25 | 0.71 | 150 |

TABLE 2-continued

| Trial Data: R457 Brightness, E313 Whiteness, $DE(\Delta E) = Sq.rt.[(L_0 - L)^2 + (a_0 - a)^2 + (b_0 - b)^2]$ | | | | |
|---|---|---|---|---|
| Time, h. | Dose, lb/t | Brightness | DE | WI E313 |
| 3.5 | 4 | 95.25 | 0.89 | 148.29 |
| 4.08 | 4 | 95.5 | 0.88 | 148.4 |
| 4.67 | 5 | 96 | 0.76 | 149.46 |
| 5.25 | 5 | 96 | 0.72 | 149.84 |
| 5.83 | 6 | 96 | 0.44 | 152.6 |
| 6.42 | 8 | 96 | 0.44 | 156.01 |
| 7 | 8 | 96 | 0.35 | 154.15 |
| 7.58 | 8 | 95.75 | 0.4 | 154.92 |
| 8.17 | 10 | 96 | 0.52 | 152.24 |

Several compositions were tested and gave good results in laboratory simulation of the PM application. The chemicals (compositions) not listed in Table 1 were applied as 40% solutions.

2. Reducing Agent: Sodium Metabisulfite (30% Solution)

TABLE 3

| Mixed Kraft-CTMP 1, headbox, surface application with starch (surface sizing solution) on both sides | | |
|---|---|---|
| # | Treatment | Br |
| 1 | Control | 94.34 |
| 2 | 0.27% Sodium Metabisulfite | 96.17 |

TABLE 4

| Mixed Kraft-CTMP 2, headbox, surface application with starch (surface sizing solution) on both sides | | |
|---|---|---|
| # | Treatment | Br |
| 1 | Control | 94.93 |
| 2 | 0.27% Sodium Metabisulfite | 95.63 |

TABLE 5

| Mixed kraft-CTMP 3, headbox | | | |
|---|---|---|---|
| # Treatment | Br | Gain vs. Control | Gain vs. OBA |
| 1 Control | 85.47 | 0 | |
| 2 0.2% OBA | 89.78 | 4.31 | 0 |
| 3 0.2% OBA + 0.2% Composition A | 91.05 | 5.58 | 1.27 |
| 4 0.2% OBA + 0.054% Sodium Metabisulfite | 90.6 | 5.13 | 0.82 |
| 5 0.054% Sodium Metabisulfite | 86.31 | 0.84 | |

TABLE 6

| Finished (sized) photocopying kraft 1, surface application with starch (surface sizing solution) on one side | | |
|---|---|---|
| # | Treatment | Br |
| 1 | Control | 80.00 |
| 2 | 0.27% Sodium Metabisulfite | 80.50 |

TABLE 7

| Finished (sized, with OBA) kraft 2, surface application with starch (surface sizing solution) on one side | | |
|---|---|---|
| # | Treatment | Br |
| 1 | Control | 94.78 |
| 2 | 0.27% Sodium Metabisulfite | 95.39 |

TABLE 8

| Mechanical-kraft 2 | | |
|---|---|---|
| # | Treatment | Br |
| 1 | 0.2% Sodium metabisulfite | 63.81 |
| 2 | Drum-dried (100° C.) | 62.28 |
| 3 | Air-dried (23° C.) | 64.87 |

Tables 3-8 illustrate the effect of a reducing agent sodium bisulfite (metabisulfite) and a brightness enhancing composition on paper brightness: the reducing agent improves brightness (Tables 3-8), partially compensating for the brightness loss in the dryer (Table 8). The chemistry further more improves brightness in presence of an OBA (Table 5).

3. Reducing Agents Other than Sodium Metabisulfite.

Application in a model surface sizing solution with starch

TABLE 9

| TMP1 | | | |
|---|---|---|---|
| # | Treatment | Br | Ye |
| 1 | 0.2% THP | 78.66 | 12.38 |
| 2 | 0.2% FAS | 78.75 | 12.20 |
| 3 | 0.2% TCP | 79.20 | 12.13 |
| 4 | 0.2% FAS | 78.00 | 12.17 |
| 5 | 0.2% THP + 0.01% NaNO2* | 79.22 | 12.00 |
| 6 | 0.2% TCP + 0.01% NaNO2* | 79.11 | 12.12 |
| 7 | Control | 77.51 | 12.98 |

*An activator

TABLE 10

| TMP1 | | | |
|---|---|---|---|
| # | Treatment | Br | Ye |
| 1 | Control | 78.83 | 11.95 |
| 2 | 0.2% BTHP | 81.06 | 10.90 |

TABLE 11

| RMP | | | |
|---|---|---|---|
| # | Treatment | Br | Ye |
| 1 | Control | 76.75 | 13.57 |
| 2 | 0.2% BTHP | 78.59 | 12.64 |
| 3 | 0.2% BTHP + 0.01% NaNO2* | 78.75 | 12.54 |
| 4 | 0.2% TCP + 0.01% NaNO2* | 78.38 | 12.70 |

*An activator

Tables 9-11 demonstrate the effect of reducing chemicals other than sodium metabisulfite, such as FAS and phosphorous (III) compounds.

4. Chelant-metabisulfite Compositions

TABLE 12

Kraft hardwood pulp 3, headbox

| # | Treatment | Br |
|---|---|---|
| 1 | 0% OBA 2 | 87.56 |
| 2 | 0% OBA 2 + 0.1% Composition C | 88.07 |
| 3 | 20% OBA | 92.08 |
| 4 | 20% OBA + 0.1% Composition C | 92.80 |
| 5 | 40% OBA | 93.05 |
| 6 | 40% OBA + 0.1% Composition C | 93.60 |
| 7 | 100% OBA | 93.43 |
| 8 | 100% OBA + 0.1% Composition C | 93.95 |

TABLE 13

Mixed kraft-CTMP 3, activation of an optical brightener

| # | Treatment | Br | Gain vs. Control | Synergism |
|---|---|---|---|---|
| 1 | Control | 85.48 | 0 | N/A |
| 2 | 0.2% Composition C | 86.79 | 1.35 | N/A |
| 3 | 0.2% OBA | 89.7 | 4.21 | N/A |
| 4 | 0.35% OBA | 90.73 | 5.22 | N/A |
| 5 | 0.1% Composition C | 86.34 | 0.81 | N/A |
| 6 | 0.2% OBA + 0.2% Composition C | 91.4 | 5.82 | 0.26 |
| 7 | 0.2% OBA + 0.1% Composition C | 90.78 | 5.25 | 0.23 |
| 8 | 0.35% OBA + 0.2% Composition C | 92.55 | 6.87 | 0.30 |
| 9 | 0.35% OBA + 0.1% Composition C | 92.06 | 6.54 | 0.51 |

TABLE 14

Activation of an optical brightener: kraft pulp 4, Composition C (0, 0.2%) with OBA (0, 0.2%)

| | Br | vs.(0, 0) |
|---|---|---|
| OBA1 | | |
| C0, OBA0 | 78.24 | 0 |
| C0, OBA0.2 | 79.74 | 1.5 |
| C0.2, OBA0 | 80.43 | 2.19 |
| C0.2, OBA0.2 | 82.53 | 4.29 |
| Synergism | | 0.6 |

TABLE 15

Mixed kraft-CTMP 1, headbox, activation of an optical brightener as measured by fluorescence intensities:

| Sample | Fluoresc. Intensity |
|---|---|
| Control | 33746 |
| 0.2% Composition A | 36149 |
| 0.35% OBA | 106233 |
| 0.1% Composition A + 0.35% OBA | 111609 |
| 0.2% Composition A + 0.35% OBA | 116373 |
| 0.3% Composition A + 0.35% OBA | 119845 |

TABLE 16

Kraft headbox containing OBA, activation of an optical brightener as measured by fluorescence intensities:

| Sample | Fluoresc. Intensity |
|---|---|
| Control | 87140 |
| 0.1% Composition A | 106217 |
| 0.2% Composition A | 108942 |

TABLE 16-continued

Kraft headbox containing OBA, activation of an optical brightener as measured by fluorescence intensities:

| Sample | Fluoresc. Intensity |
|---|---|
| 0.2% OBA | 117513 |
| 0.2% Composition A + 0.2% OBA | 120837 |

TABLE 17

Mixed furnish (25% softwood, 40% hardwood kraft, 35% deinked), activation of an optical brightener as measured by fluorescence intensities:

| Sample | Fluoresc. Intensity |
|---|---|
| Control | 57121 |
| 0.2% Composition A | 57567 |
| 0.91% OBA | 61339 |
| 0.2% Composition A + 0.6% OBA | 60783 |
| 0.2% Composition A + 0.45% OBA | 60868 |
| 0.2% Composition A + 0.3% OBA | 59924 |

TABLE 18

TMP 2

| Treatment | Br | Ye |
|---|---|---|
| Control | 78.43 | 12.06 |
| 0.2% Composition B | 81.11 | 10.70 |
| 0.2% (Sodium metabisulfite 3:DTPA 1) | 81.31 | 10.52 |

TABLE 19

TMP 2

| # | Treatment | Br | Ye |
|---|---|---|---|
| 1 | Control | 78.83 | 11.95 |
| 2 | 0.05% FAS + 0.15% Composition B | 81.35 | 10.72 |
| 3 | 0.2% BTHP | 81.06 | 10.90 |
| 4 | 0.1% BTHP + 0.1% Composition B | 80.28 | 11.32 |
| 5 | 0.2% (BTHP 3:DTMPA 1) | 81.40 | 10.73 |
| 6 | 0.2% Composition B | 81.30 | 10.90 |

TABLE 20

Hardwood kraft 2

| # | Treatment | Br | Ye |
|---|---|---|---|
| 1 | Control | 87.48 | 4.21 |
| 2 | 0.2% Composition B | 88.38 | 3.65 |
| 3 | 0.2% (Sodium metabisufite 30:DTPA 5:DTMPA 5) | 88.40 | 3.35 |

TABLE 21

Kraft 2, surface sizing application

| # | Treatment | Br | Ye |
|---|---|---|---|
| 1 | 0.513% Composition A, Drum dried | 88.41 | 3.51 |
| 2 | Drum dried | 87.50 | 4.01 |
| 3 | Air dried | 88.16 | 3.56 |

TABLE 22

| Kraft 2, surface sizing application | | |
|---|---|---|
| # | Treatment | Br |
| 1 | 0.2% Composition A, Drum dried | 88.31 |
| 2 | Drum dried | 87.76 |
| 3 | Air dried | 88.67 |

TABLE 23

| Mechanical-kraft pulp blend, headbox furnish, wet end application | |
|---|---|
| | Br |
| 0.1% Sodium metabisulfite + 0.1% (DTMPA 2:Polyacrylate 1, 33% actives), Drum dried | 65.16 |
| Drum-dried | 62.28 |
| Air-dried | 64.87 |

TABLE 24

| Kraft 5, treated handsheets, 4 days at 70° C., 100% humidity | | | | |
|---|---|---|---|---|
| # | Treatment | Im Br | TA Br | TA loss |
| 1 | Control | 93.75 | 92.74 | 1.01 |
| 2 | 0.2% Composition A | 94.41 | 93.57 | 0.84 |
| 3 | 0.5% Composition A | 95.16 | 94.40 | 0.76 |
| 4 | 0.2% Composition G | 94.23 | 93.41 | 0.82 |
| 5 | 0.5% Composition G | 94.68 | 94.04 | 0.64 |

TABLE 25

| Kraft 5, treated handsheets, 4 days at 70° C., 100% humidity | | | | |
|---|---|---|---|---|
| # | Treatment | Im Br | TA Br | TA loss |
| 1 | Control | 93.42 | 92.13 | 1.29 |
| 2 | 0.2% OBA | 94.20 | 92.76 | 1.44 |
| 3 | 0.2% Composition A + 0.2% OBA | 95.05 | 94.59 | 0.46 |
| 4 | 0.2% Composition G + 0.2% OBA | 94.89 | 94.39 | 0.50 |
| 5 | 0.5% Composition G | 94.59 | 94.17 | 0.42 |

TABLE 26

| Kraft 2, 10% consistency pulp, 3 h at 70° C. | | |
|---|---|---|
| # | Treatment | Br |
| 1 | Original pulp (no exposure to heat) | 88.05 |
| 2 | Control (exposure to heat) | 87.11 |
| 3 | 0.2% Composition A | 87.99 |
| 4 | 0.2% Composition G | 87.90 |
| 5 | 0.5% Composition A | 87.94 |
| 6 | 0.5% Composition G | 88.47 |

TABLE 27

| Kraft 2, 10% consistency pulp, 6 h at 70° C. | | |
|---|---|---|
| # | Treatment | Br |
| 1 | Original pulp (no exposure to heat) | 88.67 |
| 2 | Control (exposure to heat) | 87.76 |
| 3 | 0.2% Composition A | 88.31 |
| 4 | 0.2% Composition G | 88.34 |
| 5 | 0.5% Composition A | 88.61 |
| 6 | 0.5% Composition G | 88.67 |

Tables 12-27 illustrate application of compositions where a reducing agent is combined with chelant(s). Different combinations can be compared (all effective). The formulations improve long-term brightness stability of paper toward thermal aging (Tables 24-27). This set of data also demonstrates an OBA activation by the compositions (Tables 12-14,25). Applying the formulation allows cutting the dose of an optical brightener. Tables 16 and 17 illustrate the effect of the formulation on fluorescence.

5. Wet End Application: Separate Application of the Composition on Pulp that Leads to Increased Performance of OBA Applied Later.

Pulp Application Procedure (80° C.) for Subsequent OBA Enhancement

TABLE 28

| Kraft 6 | | | | |
|---|---|---|---|---|
| # | % Composition A | % OBA | Br | Gain vs. Control |
| 1 | 0 | 0 | 86.78 | 0.00 |
| 2 | 0 | 0.5 | 88.70 | 1.92 |
| 3 | 0 | 0.25 | 88.22 | 1.44 |
| 4 | 0.5 | 0 | 88.05 | 1.27 |
| 5 | 0.5 | 0.5 | 91.04 | 4.26 |
| 6 | 0.50 | 0.25 | 89.38 | 2.60 |
| 7 | 0.25 | 0.25 | 90.55 | 3.77 |

TABLE 29

| Kraft 6 | | | | |
|---|---|---|---|---|
| # | % Composition G | % OBA | Br | Gain vs. Control |
| 1 | 0 | 0 | 86.64 | 0.00 |
| 2 | 0.5 | 0.5 | 91.66 | 5.02 |
| 3 | 0.5 | 0.25 | 90.69 | 4.05 |
| 4 | 0.25 | 0.25 | 89.32 | 2.68 |
| 5 | 0 | 0.5 | 89.00 | 2.36 |
| 6 | 0.5 | 0 | 87.68 | 1.04 |

TABLE 30

| Kraft 6, activation of an optical brightener as measured by fluorescence intensities: | |
|---|---|
| Sample | Fluoresc. Intensity |
| Control | 7871 |
| 0.5% Composition G | 10370 |
| 0.5% OBA | 128578 |
| 0.5% Composition G, then 0.5% OBA | 201199 |
| 0.25% Composition G, then 0.5% OBA | 161354 |
| 0.5% Composition G, then 0.25% OBA | 157359 |
| 0.5% Composition A, then 0.5% OBA | 191759 |

Tables 28-30 illustrate activation of an OBA via prior application of a composition.

6. Wet End Application: Introducing a Low Dose of Dithiocarbamates into the Composition.

TABLE 31

| RMP, couch (wet end) application in water | | | | |
|---|---|---|---|---|
| # | % Composition A | % DTC | Br | Ye |
| 1 | 0.257% | 0.0025% | 79.53 | 11.65 |
| 2 | 0.257% | 0.00125% | 79.73 | 11.93 |

TABLE 31-continued

| RMP, couch (wet end) application in water | | | | |
|---|---|---|---|---|
| # | % Composition A | % DTC | Br | Ye |
| 3 | 0.184% | 0.0025% | 80.05 | 11.63 |
| 4 | 0.184% | 0.00125% | 79.98 | 11.51 |
| Air dried | | | 80.15 | 11.30 |
| Drum dried | | | 78.28 | 12.60 |

TABLE 32

| RMP, surface sizing application | | | | | | | |
|---|---|---|---|---|---|---|---|
| # | % Composition A | % DTC | Im Br | Im. Ye | TABr | TAYe | % Inh. |
| 1 | 0.513% | 0.0025% | 79.35 | 12.16 | 77.91 | 12.56 | 27 |
| 2 | 0.513% | 0.0050% | 78.78 | 12.65 | 77.79 | 12.7 | 50 |
| Drum dried | | | 77.9 | 12.92 | 75.93 | 13.82 | |

TABLE 33

| Kraft, surface sizing application | | | | | | | |
|---|---|---|---|---|---|---|---|
| # | % Composition A | % DTC | Im Br | Im Ye | TABr | TAYe | % Inh. |
| 1 | 0.513% | 0.0025% | 87.74 | 3.98 | 86.24 | 4.46 | 31 |
| 2 | 0.513% | 0.0050% | 87.17 | 4.52 | 86.27 | 4.54 | 58 |
| Drum dried | | | 87.64 | 3.92 | 85.47 | 5.05 | |

The data (Tables 31-33) illustrate brightness recovery and long-term stabilization upon application of the proposed formulations.

While the present invention is described above in connection with representative or illustrative embodiments, these embodiments are not intended to be exhaustive or limiting of the invention. Rather, the invention is intended to cover all alternatives, modifications and equivalents included within its spirit and scope, as defined by the appended claims.

The invention claimed is:

1. A method of preparing a treated bleached pulp material having enhanced brightness and enhanced resistance to thermal yellowing comprising:

i) providing bleached pulp material consisting essentially of bleached kraft pulp with a R457 ISO brightness at least about 86.64; and ii) contacting the bleached pulp material in a papermaking or tissue making process with about 0.005 to about 0.08 weight percent, based on oven-dried pulp material of one or more reducing agents wherein the reducing agents are added to the bleached pulp material (a) in a blending or transfer chest; (b) before or after the cleaners; (c) before or after the fan pump to the paper machine headbox; (d) to the paper machine white water; (e) to the silo or save all; (f) in the press section; or (g) in the curl control unit, wherein the reducing agents are selected from the group consisting of sulfites, bisulfites, metabisulfites (pyrosulfites), and dithionites (hydrosulfites) wherein said bisulfites are selected from monobasic metal salts of sulfurous acid and said sulfites are selected from dibasic metal salts of sulfurous acid.

2. The method of claim 1 further comprising contacting the bleached pulp material with one or more optical brighteners.

3. The method of claim 2 wherein the optical brighteners are selected from dilsulfonated, tetrasulfonated or hexasulfonated stilbene derivatives.

4. The method of claim 1 further comprising contacting the bleached pulp material with one or more chelants.

5. The method of claim 4, wherein the chelants are selected from the group consisting of organic phosphonates, phosphates, carboxylic acids, dithiocarbamates, salts of any of the previous members, and any combination thereof.

6. The method of claim 5, wherein the chelants are selected from the group consisting of diethylene-triamine-pentamethylene phosphonic acid (DTMPA) and salts thereof, diethylenetriaminepentaacetic acid (DTPA) and salts thereof and ethylenediaminetetraacetic acid (EDTA) and salts thereof.

7. The method of claim 1, wherein the reducing agents are selected from the group consisting of sulfites, bisulfites and metabisulfites.

8. The method of claim 7, wherein the reducing agent is sodium bisulfite.

9. The method of claim 1 further comprising contacting the bleached pulp material with one or more polycarboxylates.

10. The method of claim 9 wherein the polycarboxylate is partially neutralized polyacrylic acid.

11. The method of claim 1 further comprising contacting the bleached pulp material with one or more optical brighteners, one or more chelants and one or more polycarboxylates.

12. A method of preventing brightness loss and yellowing of a bleached pulp material during storage comprising:

adding to a bleached pulp material consisting essentially of bleached kraft pulp with a R457 ISO brightness at least about 86.64, about 0.005 to about 0.08 weight percent, based on oven-dried pulp material of one or more reducing agents and adding optionally one or more chelants, one or more polycarboxylates, or combinations thereof, to the bleached pulp material wherein the reducing agents and optional chelants and polycarboxylates are added to the bleached pulp material in the blending or transfer chest and wherein the reducing agents are selected from the group consisting of sulfites, bisulfites, metabisulfites (pyrosulfites), dithionites (hydrosulfites), wherein said bisulfites are selected from monobasic metal salts of sulfurous acid and said sulfites are selected from dibasic metal salts of sulfurous acid.

13. A method of making a paper product having enhanced brightness and resistance to thermal yellowing comprising:

i) providing bleached pulp material consisting essentially of bleached kraft pulp with a R457 ISO brightness at least about 86.64;

ii) forming an aqueous stock suspension comprising the bleached pulp;

iii) draining the stock suspension to form a sheet;

iv) drying the sheet; and v) adding about 0.005 to about 0.08 weight percent, based on oven-dried pulp material of one or more reducing agents and an effective amount of one or more chelants, one or more optical brightening agents or one or more polycarboxylates, or combinations thereof on to the sheet after step iii) and before step iv), wherein the reducing agents are selected from the group consisting of sulfites, bisulfites, metabisulfites (pyrosulfites), dithionites (hydrosulfites), wherein said bisulfites are selected from monobasic metal salts of sulfurous acid and said sulfites are selected from dibasic metal salts of sulfurous acid.

14. The method of claim 13, wherein the reducing agents are selected from the group consisting of sulfites, bisulfites and metabisulfites.

15. The method of claim 14, wherein the reducing agent is sodium bisulfite.

16. The method of claim 13, wherein the chelants are selected from the group consisting of organic phosphonates, phosphates, carboxylic acids, dithiocarbamates, salts of any of the previous members, and any combination thereof.

17. The method of claim 16, wherein the chelants are selected from the group consisting of diethylene-triamine-pentamethylene phosphonic acid (DTMPA) and salts thereof, diethylenetriaminepentaacetic acid (DTPA) and salts thereof and ethylenediaminetetraacetic acid (EDTA) and salts thereof.

18. The method of claim 13 wherein the optical brighteners are selected from dilsulfonated, tetrasulfonated or hexasulfonated stilbene derivatives.

19. The method of claim 13 further comprising adding one or more polycarboxylates onto the sheet.

20. The method of claim 19 wherein the polycarboxylate is partially neutralized polyacrylic acid.

21. A method of making a paper product having enhanced brightness and resistance to thermal yellowing comprising:

i) providing bleached pulp consisting essentially of bleached kraft pulp with a R457 ISO brightness at least about 86.64;

ii) forming an aqueous stock suspension comprising the bleached pulp;

iii) draining the stock suspension to form a sheet;

iv) drying the sheet; and v) applying a composition comprising one or more reducing agents and one or more chelants to the sheet wherein the reducing agents are selected from the group consisting of sulfites, bisulfites, metabisulfites (pyrosulfites), dithionites (hydrosulfites), and wherein said bisulfites are selected from monobasic metal salts of sulfurous acid and said sulfites are selected from dibasic metal salts of sulfurous acid wherein the reducing agents are applied to the sheet in a dosage of about 0.005 to about 0.08 weight percent, based on oven-dried pulp material.

22. The method of claim 21 wherein the reducing agents and chelants are mixed with a surface sizing solution and applied to the sheet in a size press.

23. The method of claim 21, wherein the reducing agents are selected from the group consisting of sulfites, bisulfites and metabisulfites.

24. The method of claim 23, wherein the reducing agent is sodium bisulfite.

25. The method of claim 21, wherein the chelants are selected from the group consisting of diethylene-triamine-pentamethylene phosphonic acid (DTMPA) and salts thereof, diethylenetriaminepentaacetic acid (DTPA) and salts thereof and ethylenediaminetetraacetic acid (EDTA) and salts thereof.

* * * * *